United States Patent [19]

Wenzel et al.

[11] 3,942,434

[45] Mar. 9, 1976

[54] DEVICE FOR ADJUSTING THE ROLLER BIGHT OF SUPERIMPOSED ROLLERS OF A CALENDER

[75] Inventors: Reinhard Wenzel; Siegfried Reich, both of Tonisvorst, Germany

[73] Assignee: Kleinewefers Industrie-Companie GmbH, Krefeld, Germany

[22] Filed: Apr. 3, 1974

[21] Appl. No.: 457,637

[30] Foreign Application Priority Data

Apr. 4, 1973 Germany ..... 2316745

[52] U.S. Cl. ..... 100/168; 100/47

[51] Int. Cl.[2] ..... B30B 3/04

[58] Field of Search ..... 100/155–171, 100/47, 99; 72/21, 35

[56] References Cited

UNITED STATES PATENTS

| | | | |
|---|---|---|---|
| 3,331,313 | 7/1967 | Notbohm et al | 100/47 |
| 3,364,848 | 1/1968 | Müller | 100/170 X |
| 3,369,483 | 2/1968 | Müller | 100/170 X |
| 3,373,681 | 3/1968 | Jaegers | 100/170 X |
| 3,555,596 | 1/1971 | Thieme | 100/170 |
| 3,584,570 | 6/1971 | Sass et al. | 100/170 |
| 3,777,656 | 12/1973 | Müller | 100/47 |

*Primary Examiner*—Peter Feldman
*Attorney, Agent, or Firm*—Walter Becker

[57] ABSTRACT

A device for adjusting the roller gap of superimposed rollers of a calender with upwardly and downwardly movable spindles suspended on both sides of the calender which extend through supporting means on lateral ends of roller bearings. Below each supporting means a spindle nut is adjustable relative to the pertaining supporting means. The distance between each spindle nut and the supporting means thereabove is adapted to be sensed. Each supporting means carries a feeler head of a proximity switch and a vertical guiding bar having guided thereon a marker adjustable by the respective spindle nut on the pertaining guiding bar in the longitudinal direction of the pertaining guiding bar.

11 Claims, 6 Drawing Figures

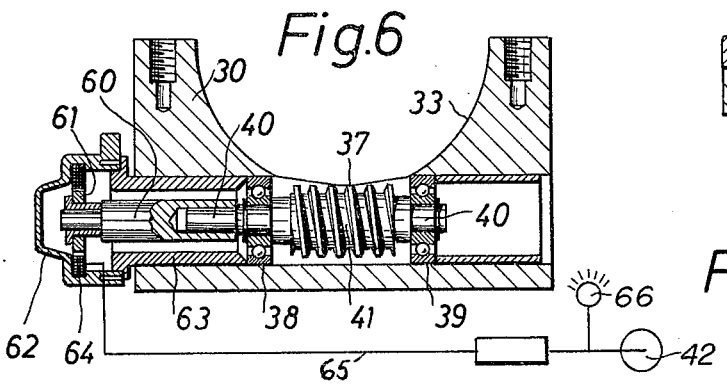
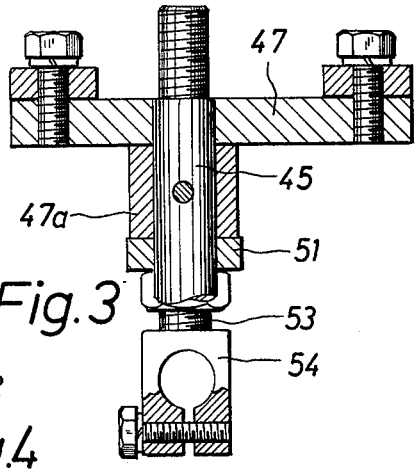
Fig.3
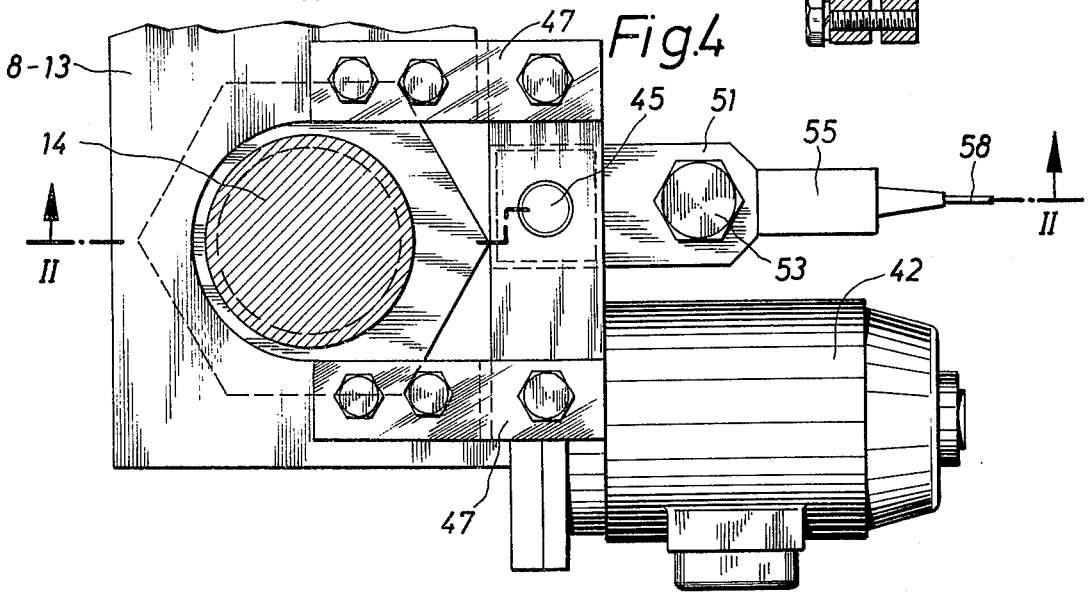
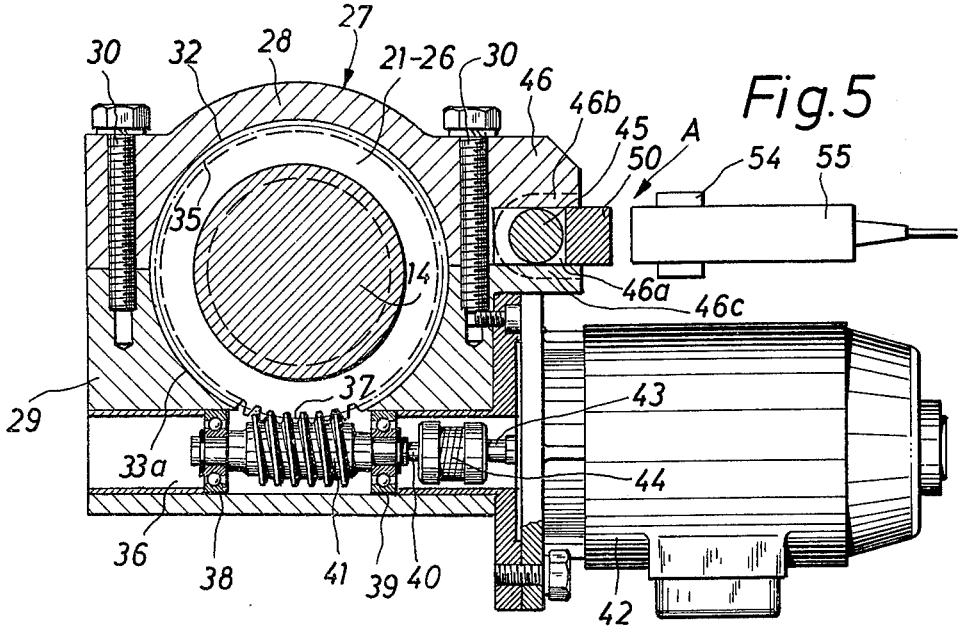

DEVICE FOR ADJUSTING THE ROLLER BIGHT OF SUPERIMPOSED ROLLERS OF A CALENDER

The present invention relates to a device for setting the roller bight of calender rollers arranged one above the other, which device is provided at both calender sides with suspended spindles adapted to be lifted and lowered. These spindles extend through supporting members provided on the lateral ends of the roller bearings while on said spindles below each supporting member a spindle nut is adjustable relative to the respective adjacent supporting member; the distance between the respective spindle nut and the adjacent supporting member thereabove is adapted to be sensed or scanned.

The calender rollers arranged one above the other after a certain period of use have to be turned off so that their diameter will be reduced or when the diameter has dropped below a certain length, have to be exchanged for new rollers. Furthermore, for purposes of pulling in the web of goods to be treated and when a paper tear is involved and when folds move into the roller gap whereby the surface of the roller and of the web of goods is harmfully affected, it is necessary within a short time to lift the superimposed rollers off each other by a slight distance of from 3 to 10 millimeters. This lifting off to the mentioned extent has to be effected independently of whether the rollers are turned off or have been replaced by new ones, in other words, it has to be effected independently of the change in diameter of the rollers.

To this end, two suspended spindles adapted to be lifted and lowered are provided on both calender sides, which spindles extend through the lateral supporting members of the roller bearings and on which spindles spindle nuts are provided which are spaced from the supporting members by a distance corresponding to the desired distance of adjacent rollers when the latter are lifted off from each other. The spindle nuts in conformity with the above described post-turning or machining of the rollers or in conformity with the replacement of the rollers by new rollers have to be set or adjusted on the spindle nut. This adjustment of the spindle nuts also following the exchange or re-machining of the rollers is generally effected manually by means of gauges or measured by the eye. This, however, requires considerable time.

Therefore, it has been suggested to effect the adjustment of the spindle nuts by a motor. According to one of these suggestions, the spindle nuts are adjusted relative to the suspended spindles by holding said spindle nuts by an arresting device stationary relative to the turning spindles so that the spindle is adjusted in its axial direction relative to the arrested nut. With this embodiment, a pushrod rests on the nut which when not held stationary turns with the spindle. The shank of said pushrod extends through the supporting member and its head moves against two stationary contacts of the supporting member whereby a circuit is closed which actuates the arresting device for the respective spindle nut.

This arrangement has the drawback that the contact pushrod rests on a turning spindle nut and either brakes the same and affects the adjustment of the spindle nut, or the movement and arrangement of the pushrod within the bore of the supporting member and the contacts require a continuous observation of the parts.

It is, therefore, an object of the present invention to provide a device of the above mentioned general type by means of which an inexpensive trouble-free and precise pulse emission is effected for the adjustment of the spindle nut on the suspended spindle. The dust containing atmosphere of the calenders, in particular the bending of the spindles, the play of the spindle nuts on the spindles and the play in the guiding means for the supporting members on the calender stands have to be taken into consideration.

These and other objects and advantages of the invention will appear more clearly from the following specification, in connection with the accompanying drawings, in which:

FIG. 3 represents a detail of the arrangement of the approximation switch and represents a section along the line III—III of FIG. 2.

FIG. 4 is a section taken along the line IV—IV of FIG. 2. FIG. 5 is a section taken along the line V—V of FIG. 2.

FIG. 6 shows the pulse emitter on the worm shaft of the spindle nut drive.

Figure 1:
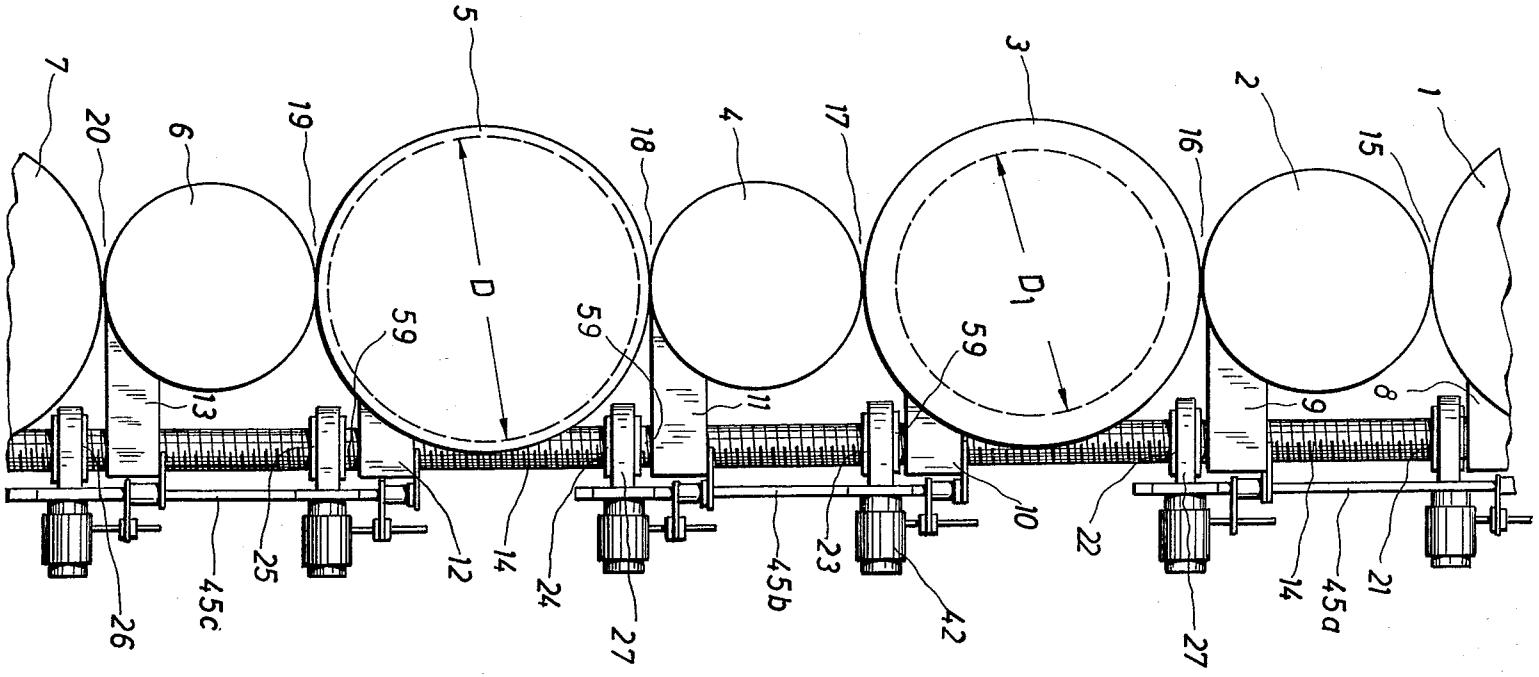
FIG. 1 shows a part of a calender side with a device according to the present invention.

For purposes of solving the problem underlying the present invention, the present invention starts with a device of the above described general type and provides that each supporting member of the roller bearings supports a feeler head of an proximity switch and also supports a vertical guiding bar on which there is guided an adjusting marker or switching flag which is adjustable by the spindle nut on the guiding bar in the longitudinal direction thereof.

Inasmuch as proximity switches have become known in various forms and for various uses the scope of the device according to the invention is intended only for the specific adaptation and arrangement of the parts of the proximity switch with regard to the above mentioned device for setting the roller bight as well as to the specific design of the parts of the device themselves.

The difficulty of the utilization of known contact-free proximity switches with devices of the described type consisted primarily in that deviations in the spindle axiality, the play of the nuts on the spindles and lack of precision in the guiding of the supporting members on the calender stands may cause errors which when added together might amount to from 5 to 10 millimeters so that a sufficiently high sensing precision is impossible. These errors are eliminated in conformity with the present invention, and an error-free sensing is realized by arranging the feeler head and the adjusting marker on the same calender part, namely, the supporting part while the adjusting markers are adjustable as to height by the pertaining nut.

According to one embodiment of the invention, the feeler head is adjustable as to height on the adjusting member. According to other embodiments or in addition thereto, the feeler head may also be arranged laterally adjacent the path of movement of the adjusting marker or laterally of the extension of the path of movement of such adjusting marker and may be adjustable toward said path or its extension thereof and may also be adjustable away therefrom.

According to a further development of the invention, the rim of the spindle nut may surround the adjusting marker at the upper and lower end. On the other hand, an annular bead may be provided on the outer rim of the nut and may engage the fork-shaped adjusting marker or a similar intermediate element.

A particularly advantageous embodiment of the invention consists in a device in which the spindle nut is provided with an annular or holding element surrounding said spindle nut, said annular member or holding member being nonrotatable in view of a vertical bar of the supporting member. German Gebrauchsmuster No. 1,901,299 shows and describes such suspended spindles for calenders of considerable height in which the spindle nut is embraced by a nonrotatable ring or holding member which has a transmission for driving the spindle nut. With a device of this type, according to a further development of the invention, the adjusting marker is guided on the bar for the ring and holding member. As a result thereof, a relatively light and space saving arrangement of the proximity switch is obtained. Preferably, the feeler head is connected to a motor for each spindle nut on the ring or annular member.

According to an embodiment in which each spindle nut is driven by a worm shaft, a pulse emitter may be arranged on said worm shaft, which pulse emitter is connected to the proximity switch or its connecting line to the spindle nut motor. This pulse emitter may be formed by an armature arranged on the worm shaft and rotating within a magnetic field. The pulse emitter sees to it that if one of the motors of a spindle nut fails, or when said spindle nut does not turn for another reason, a pulse for turning off all motors is emitted so that a non-uniform adjustment of the spindle nuts will be avoided.

Referring now to the drawings in detail, the rollers 1 – 7 of the calender are arranged one above the other in said calenders while the rollers 1 – 6 are held on each calender side by supporting members 8 – 13, these supporting members supporting bearings for the nonillustrated roller shafts. Each supporting member 8 – 13 is passed through on each calender side by a threaded spindle 14 which is nonrotatably but longitudinally adjustable from a lower starting position to an upper position and vice versa. With this longitudinal movement, the roller bights 15 – 20 may be increased to from 3 to 10 millimeters so that on one hand the web of goods will be introduced between the rollers 1 – 7 and on the other hand, when a paper tear occurs or when folds are formed in the web of goods, an immediate lifting off of the rollers from each other can be effected in order to protect the roller surfaces against damage.

According to the specific showing in FIG. 1, the there illustrated threaded spindle 14 occupies its starting position. For purposes of lifting the rollers 1 – 6, in other words, its supporting parts 8 – 13, each threaded spindle 14 is provided with nuts 21 – 26 which are arranged on the spindle 14 below the supporting parts 8 – 13 pertaining thereto. The distance between a spindle nut and its supporting member as shown in FIG. 1 is different and is provided with the reference numeral 59. If each roller is to be lifted off from the roller therebelow, for instance, by 5 millimeters, the distance of the uppermost spindle nut from its supporting member amounts to 5 millimeters, whereas the spindle nut therebelow is spaced from its supporting member already by 10 millimeters, and while the third spindle nut has a distance of approximately 50 millimeters, etc., so that the magnitude of the distances 59 increases in downward direction from the top.

When the rollers are re-machined or trued, for instance, if the roller 3 is machined to a diameter $D_1$ and the roller 5 is machined to the diameter D, it will be appreciated that in this way the distance between the axles of the individual rollers and the nuts 23 – 26 require a corresponding adjustment. In order with this post adjustment to be able in a simple manner to ascertain whether the desired distance of the spindle nuts from their supporting members has been obtained, the following arrangement according to the invention is provided.

The spindle nuts 21 – 26 are, as particularly clearly shown in FIG. 5 surrounded by a two-sectional ring or holding member 27. This ring member or holding member 27 consists of two sections 28, 29, which are held together by screws 30. The inner ring 31 (FIG. 2) of the semicircular recesses 32, 33 of each ring or holding section 28, 29 extends into a rectangular groove 34 (FIG. 2) which is open toward the outside and is provided in the spindle nuts 21 – 26 so that the spindle nut will be able to turn within the annular or holding member 27. On the other hand, an annular bead B may be provided on the nut holding member 27 of the nut 26 and may engage the fork-shaped adjusting marker 50 or similar intermidiate element. The ring or holding member 27 which as will be described further below in detail, is prevented from rotating, can be adjusted with the spindle nut 21, 26 in the longitudinal direction of the suspended spindle 14. For turning the spindle nuts 21 – 26 within the ring or holding members 27, there is provided a worm thread 35 arranged on the circumference of the spindle nut at the level of the groove 34.

Arranged tangentially with regard to the spindle nuts 21 – 26, and more specifically, in the part 29 of the ring or holding member 27 is a bore 36 into which at 37 the spindle nut extends with its thread 35. The bore 36 has arranged therein two bearings 38, 39 for a worm shaft 40 on which a worm 41 is arranged which meshes with the thread 35 of the spindle nut 21 – 26. The worm shaft 40 is driven by a motor 42, the shaft 43 of which is connected through a coupling 44 to the worm shaft 40.

Parallel to each suspended spindle 14 on each calender side and between adjacent supporting members 8 – 13 there extends vertically one bar 45 each which extends through an outwardly open rectangular slot **46*a* of the section 46 of the ring or holding member 27 (FIG. 5). By means of this bar 45, the ring or holding member 27 is prevented from rotating but is still able with the spindle nut 21 – 26 to carry out a vertical movement which means to carry out a movement along the spindle 14. The bars 45 are connected to the supporting members 8 – 13 and can be replaced by a bar which is mounted on the supporting members 8 – 13** and replaces the individual bars while extending over the height of the calender stand.

Each of the supporting members 8 – 13 has a lateral extension 47 with intermediate members **47*a* which hold the bar 45 on which two jaws 48 are vertically guided between which an adjusting marker 50 is held by means of screws 49. This marker 50 has a height which corresponds to the width of the holding member 27. If necessary, spacer members may be employed. The rims 46*b* and 46*c* of the rectangular slot 46*a* of the section 46 of holding member 27 extend into the frame-shaped body formed by the jaws and the marker 50. The marker 50 is thus precisely vertically guided on the supporting member 8 – 13, whereas the spindle nut 21 – 26 can independently thereof carry out any lateral movement. On the other hand, its vertical movement is precisely conveyed to the marker 50**.

Arranged on the intermediate member 47*a* connected to the supporting member 8 – 13 is a strip 51 which has a bore 52 for receiving a threaded pin 53. The free lower end of pin 53 has a clamp 54 through which extends the feeler head 55 of the proximity device. Thus, the feeler head 55 by adjusting the threaded pin 53 by means of nuts 57 can be adjusted as to height relative to the strip 51 and by a longitudinal adjustment in the clamp 54 can be adjusted in the direction of the arrow 56. The connection 58 of the feeler head is connected to the motor 42 or an intermediate control device.

Figure 2:
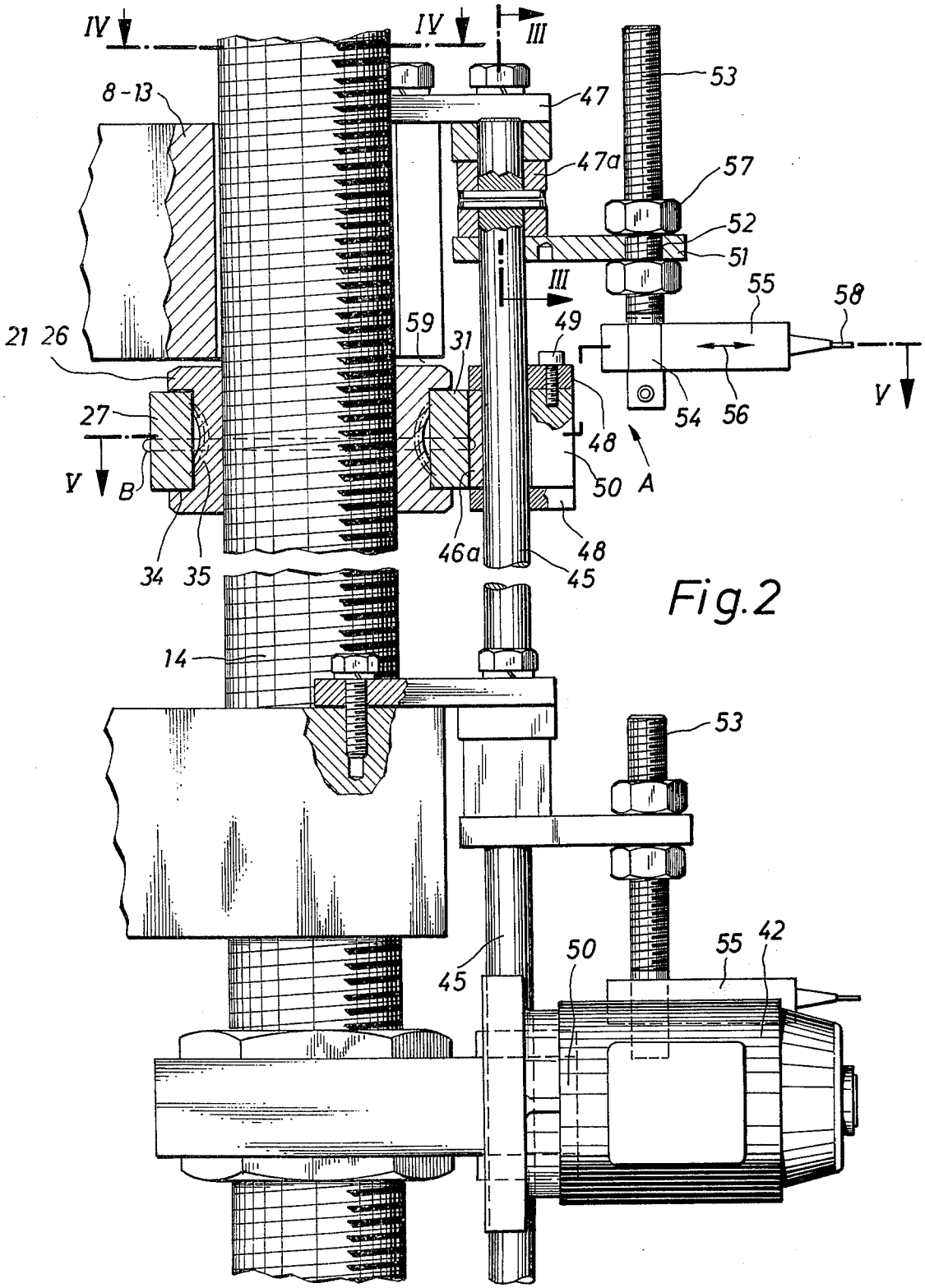
FIG. 2 illustrates on a scale larger than that of FIG. 1 a cutout of the calender side of FIG. 1 and a section taken along the line II—II of FIG. 4.

As will be evident from FIGS. 1 and 2, the marker 50 projects beyond the supporting member 8 – 13 in such a way that the path of movement of the marker 50 will not be affected, whereas on the other hand the adjustment of the feeler head 55 may likewise be effected in any desired fine manner. In this connection, the marker 50 and the feeler head are together supported by the holding member which means that they are together directly or indirectly arranged on the bar 45.

Inasmuch as the sensing device according to the invention cannot prevent that in case of failure of a motor 42 the spindle nuts of the individual spindles are moved in a different manner with regard to each other, there is provided on shaft 40 extension 60 which carries an armature 61 arranged in the extension 62 of a bushing 63. In this extension 62 of the bushing 63 there is provided an annular magnet 64 adapted to build up a magnetic field. As long as shaft 40 rotates, the magnetic field is influenced in a certain manner. If, however, the shaft does not rotate due to the failure of motor 42 or due to a break in the coupling, the magnetic field is not changed and a pulse is generated which either actuates a signaling device, or stops all remaining motors of the device until all motors have again been put into operative condition.

The impulse generator is arranged upon the extension 60 of the worm shaft 40. The extension supports an armature 61 which projects into an annular magnet 64. This magnet according to FIG. 6 is connected by way of a line or conduit 65 on the one hand with a signal generator 66 or, however, with several remaining motors 42. Hereby there is provided what is selfunderstood for every average man skilled in the art, namely, and equalizer in the line 65 in the form for instance of a bridge and the like (bridge circuit) so that during standing still of the shaft 40 there becomes generated an impulse whereas during rotation of the shaft an equalization becomes achieved or attained in such a manner that neither the signal device nor the motors receive an impulse.

As will be evident from the above description, the spindle nut 21 – 26 is adapted to carry out any desired relative horizontal movements relative to the marker 50, however, the said spacing ratio between the marker 50 and the feeler head remains the same.

It is, of course, to be understood that the present invention is, by no means, limited to the specific showing in the drawings, but also comprises any modifications within the scope of the appended claims. Thus, the present invention also comprises an embodiment in which the guiding bar is connected to the ring or holding member 21, 26, and in which the feeler head is guided by bars.

What we claim is:

1. A device for adjusting the roller bight of superimposed rollers of a calender, which includes in combination: a plurality of supporting means arranged at both sides of said calender and comprising means for rotatably supporting said rollers, said supporting means being arranged in vertically spaced relationship to each other, continuous spindle means movable upwardly and downwardly and extending through said supporting means for movement therethrough, a plurality of spindle nuts respectively threadedly mounted on said spindle means below the respective supporting means and adjustable relative thereto, and a plurality of sensing means respectively supported by said supporting means and each including a proximity switch with feeler head and also a guiding bar with a marker movably guided on said guiding bar, each of said markers being adjustably connected to the pertaining spindle nut for movement on the pertaining guiding bar.

2. A device in combination according to claim 1, in which each of said feeler heads and markers is associated with a common guiding bar.

3. A device in combination according to claim 1, in which said feeler head of each proximity switch is adjustable as to height on the pertaining supporting means.

4. A device in combination according to claim 1, in which each one of said feeler heads is arranged laterally of and adjacent to the path of movement of the pertaining marker and is adjustable toward and away from saaid path of movement.

5. A device in combination according to claim 1, in which each of said spindle nuts has an outer rim portion thereof embracing the pertaining marker from above and from below.

6. A device in combination according to claim 4, in which each of said markers has a fork-shaped portion and in which the outer rim of each of said nuts has aan annular bead engaging the fork-shaped portion of the pertaining marker.

7. A device in combination according to claim 3, which includes a plurality of holding members respectively surrounding said spindle nuts, and respectively held non-rotatably by said guiding bar, said marker being guided accurately on the pertaining guiding bar.

8. A device in combination according to claim 7, which includes a plurality of motor means respectively operatively connected to said feeler heads associated with the respective spindle nut.

9. A device in combination according to claim 8, which includes a plurality of worm shafts respectively operable by said motors and drivingly connected to the pertaining spindle nuts, and pulse emitter means respectively arranged on the respective worm shaft and connected to the pertaining proximity switch.

10. A device in combination according to claim 8, which includes a plurality of worm shafts respectively operable by said motors and drivingly connected to the pertaining spindle nuts, and pulse emitter means respectively arranged on said worm shafts and electrically connected to the respective motor.

11. A device in combination according to claim 10, in which said pulse emitters are formed by armatures rotatably arranged on the pertaining worm shaft in a magnetic field.

* * * * *